US006561379B1

(12) United States Patent
Goh

(10) Patent No.: US 6,561,379 B1
(45) Date of Patent: May 13, 2003

(54) PACKAGING BOX FOR TABLETS

(76) Inventor: Djing San Goh, Schoolstraat 9(1), 1431 BG Aalsmeer (NL)

( * ) Notice: Subject to any disclaimer, the term of this patent is extended or adjusted under 35 U.S.C. 154(b) by 0 days.

(21) Appl. No.: 09/644,612

(22) Filed: Aug. 24, 2000

(30) Foreign Application Priority Data

Aug. 25, 1999 (DE) ..... 29914997 U

(51) Int. Cl.[7] ..... G07F 11/06

(52) U.S. Cl. ..... 221/90; 221/263

(58) Field of Search ..... 221/220, 288, 221/263, 267, 90, 264, 265, 89; 206/528

(56) References Cited

U.S. PATENT DOCUMENTS 3,622,041 A * 11/1971 Borsum ..... 221/288
6,267,265 B1 * 7/2001 Issa ..... 221/90

* cited by examiner

*Primary Examiner*—Kenneth W. Noland
(74) *Attorney, Agent, or Firm*—Charles A. Wilkinson

(57) ABSTRACT

A dispensing container is provided having a side discharging dispensing cap which is smaller than the end of the container and hinged to the container at a position slightly beyond the opening of the container and includes a position control arrangement for the cap to releasably position it in closed and dispensing positions including a protrusion from the inside of one side wall near the top and two spaced depressions in the structure of the dispenser cap.

14 Claims, 3 Drawing Sheets

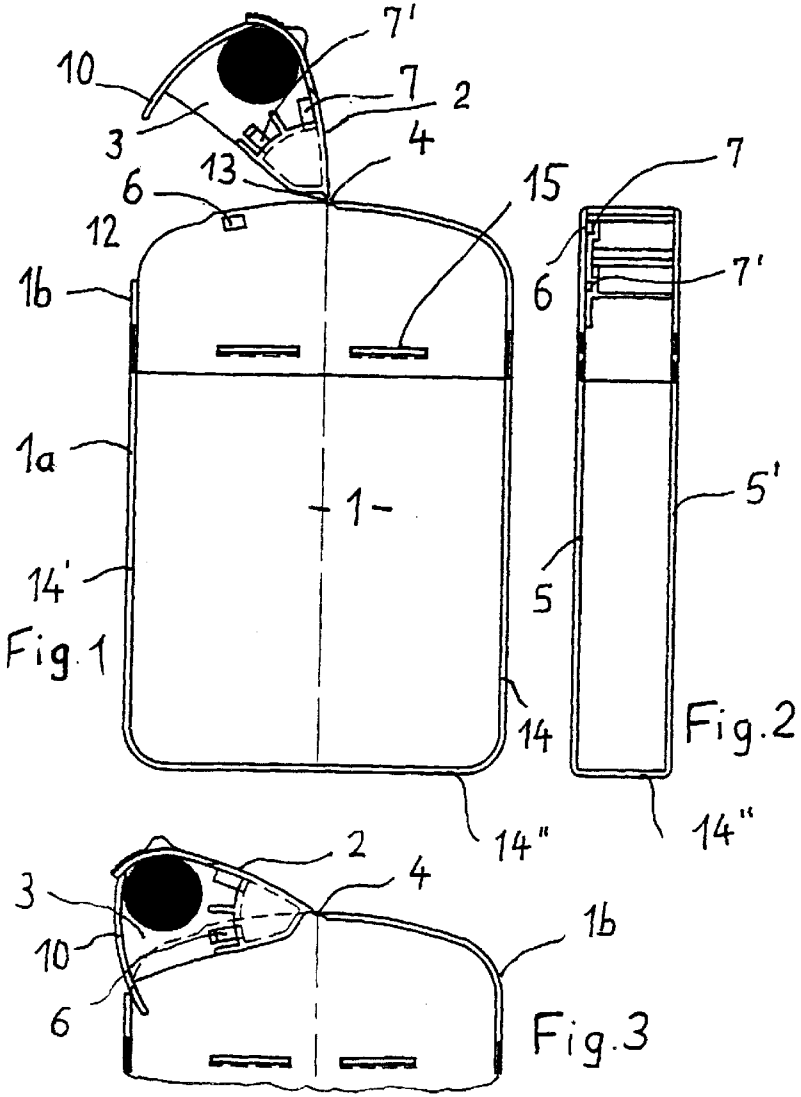
7'
7
2
4
10
3
13
6
12
15
1b
1a
14'
1
14
14"
Fig.1
7
7'
6
5'
5
14"
Fig.2
1b
4
2
3
10
6
Fig.3
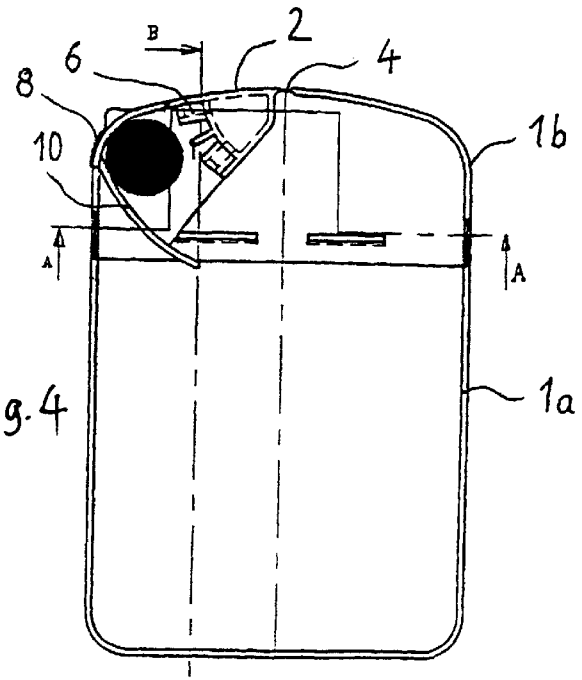
1b
4
2
B
6
8
10
A
A
1a
B
Fig.4
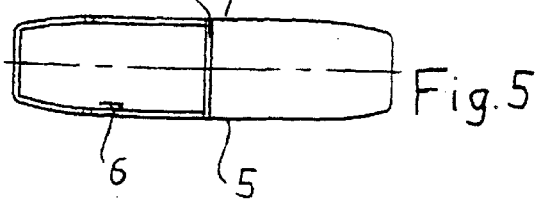
5'
13
5
6
Fig.5

1b
1a
4
2
16
17'
11
17
A
B
10

1b
4
2
8
19
18
11
19'
A
B

19'
11
19

2
1b
1a 2
3
4
19
10
11
19'
18
1b
1a 4
2
19
11
19'
18

PACKAGING BOX FOR TABLETS

RELATED APPLICATIONS

This application is based upon German application Serial No. 299 14 997.1 filed Aug. 25, 1999 from which priority is claimed.

BACKGROUND OF THE INVENTION

1. Field of the Invention

This invention relates generally to packaging and more particularly to plastic dispensing containers intended for storage and single dispensing of tablets and other regularly shaped small candy and medicinal products.

2. Description of the Prior Art

In recent years, there have been a number of so-called plastic or polymeric medical tablet dispensing packages frequently in the form of screw-topped tablet bottles having various so-called childproof tops. Since typical screw caps for these containers have been rounded to facilitate rotational removal and reapplication to the container, the container itself is usually cylindrical in outline. There have also been more or less rectangular small candy containers of various sorts. Most of these containers have involved multiple parts and have been relatively expensive to produce as well as assemble if not made in one piece.

The present inventor has previously developed a dispensing container comprised of a generally rectangular container having a sealing cap connected to the container body by a thin film hinge manufactured preferably as a unit in a simple injection molding step. The sealing cap has an open chamber in one side designed to be just large enough to accommodate one or two tablets or candies, which when the sealing cap is opened by pivoting it outwardly, enables the tablet or candy to be dispensed from the open side of the sealing cap. The sealing cap or hinged sealing cap of this previous invention is provided with extensions that pass over a longitudinal internal rib in the container as the sealing cap is pivoted open or closed providing both catches to hold the cap open in either of two positions or closed and also providing a distinctive clicking sound that advises the user of the position and operation of the sealing cap.

While the present inventor's prior dispensing container has proven very satisfactory and has considerable commercial appeal, it has been found to have some minor previously unrecognized disadvantage including interference of the longitudinal rib with the otherwise open interior of the container, complications in the injection molding operation and the like which generally increase the cost. Complications in filling and handling the containers during filling with tablets and candy are also encountered. The longitudinal rib also takes significant space within a small container so that only flat tablets or very small elongated candies can negotiate the narrow rib area in the box. There is a need, therefore, for an alternative arrangement for providing the sealing or closure cap of a small dispenser box with means for retaining the sealing cap, which is integrally connected to the main portion of the dispenser, preferably by a socalled thin film hinge, in various open or closed positions. The present inventor has provided a dispensing container, therefore, with several embodiments of closure cap retention means that take up a minimum amount of room within the storage portion of the container itself and carry the major portion of the retention mechanism within the dispensing cap of the container such that the cap may be easily provided with definite open and closed positions and, if desired, intermediate positions. The dispensing container may be made in one piece, but will usually have a two piece construction.

In addition, while the previous invention disclosed in German Application WDP 96/33927 has the advantage of being formable in a single step, because the thin film hinge is located on a side wall of the container, such single step construction is not adaptable to having the thin film hinge on other portions of the structure of the container such as the top, because the tool of the formation process cannot be withdrawn from the container at the completion of forming unless the entire end of the container can be opened. This, however, requires the closure cap used to close the end to be as large as the top of the container. By use of the constructions of the present invention, however, the pivoting closure cap can be pivoted on a thin film hinge from the upper end or top of the container which is particularly convenient in larger containers where it may not be desirable to have the entire end of the dispensing container pivot open. This also provides a smaller major arc of movement for the cap as well as a lighter cap, whereby the rigid structure of the previous cap retention system is no longer necessary. By use of the presently disclosed arrangements for controlling the opening of the side dispensing closure cap such cap can be made as small or large as desired.

OBJECTS OF THE INVENTION

It is an object of the invention, therefore, to provide an improved dispensing container having a pivoting sealing cap the position of which is controlled by at least two catches in an arcuate portion of at least one side of the dispenser cap to control the dispenser in at least two positions, namely a closed position and a dispensing position.

It is a still further object of the invention to provide an improved dispensing container having a dispensing cap attached to top of the body of the dispenser by a thin film hinge, the cap having two controlled positions, plus an uncontrolled filling position.

It is a still further object of the invention to provide a dispensing container having a pivoted side dispensing cap designed to close an opening less than the diameter of the container itself and incorporating a catch arrangement which securely holds the cap in position on the container in several positions.

It is a still further object of the invention to provide a dispensing container that can be made in several parts if it is desired to have the dispensing cap hinged other than from one of the side walls.

It is a still further object of the invention to provide a dispensing container having a pivoting dispensing cap secured to the top of the body of the dispenser by a thin film hinge and guided in and out of the dispenser from and to dispensing position by an arcuate tongue at the end of the dispensing cap plus a raised protrusion on at least one side of the container near the top in line with an arcuately arranged series of depressions in the side of the dispensing cap, which depressions, when the cap is pivoted, mate with the protrusion on the side of the container near the top to hold the cap temporarily in any position for which there is a suitable depression.

It is a still further object of the invention to provide a dispensing container having a pivoting dispensing cap secured to the body of the dispenser by a thin film hinge and guided in and out of the dispenser from and to the dispensing position by an arcuate tongue at the opposite end of the dispensing cap from the thin film hinge plus a protrusion adjacent the top of the side wall of the container which interengages with at least two raised protrusions on the guide tongue to maintain the dispensing cap in open and closed positions.

It is a still further object of the invention to provide a dispensing container having a pivoting dispenser cap attached to the container by a thin film hinge and having a protrusion at the edge of one side of the container and with an arcuate guide tongue extending into the container opposite to the thin film hinge, the guide tongue being provided at the side adjacent the protrusion in the container with at least two depressions which interengage with the protrusion from the wall of the dispensing container to hold the dispensing cap in at least a closed and a fully open position.

It is a still further broad object of the invention to provide a dispensing container having a side dispensing cap pivoted upon a thin film hinge with the container which is provided with means to hold the cap in at least the closed and open dispensing positions by means of at least one protrusion on the side wall or end wall of the container which interengages with at least two depressions in the body of the pivoting dispenser cap.

It is a still further broad object of the invention to provide a dispensing container having a side dispensing cap pivoted upon a thin film hinge from the top of the container and an arcuate guide tongue and having a protrusion on the side or end wall of the container which at least partially interengages with at least two protrusions from or on the arcuate guide tongue.

It is a still further object of the invention to provide a dispensing container having a side dispensing cap pivoted upon the container from a thin film hinge and having an arcuate guide tongue and having at least two normal positions effected by interlocking protrusions and depressions on the container and dispensing cap in which the container can be formed in two interlocking parts or units.

Additional advantages and aspects of the invention will become evident from review of the attached drawings and accompanying explanation.

SUMMARY OF THE INVENTION

This invention provides an improved dispensing container having a pivoted hinged sealing or closure cap arranged to be easily flipped open by pressing with the thumb or finger of one hand. The sealing cap, which is pivoted to the container by a thin film hinge, is provided with a side chamber which carries one or two tablets. The degree of opening of the dispensing cap is determined by how far the sealing or closure cap is moved toward several cap positions determined by interaction or engagement of a protrusion extending from the edge of the container with either several depressions in the pivoting sealing cap or protrusions from the sealing cap. Preferably the sealing cap is pivoted from the end or top of the container rather than from one side of the container and for this reason the container and sealing cap attached to one end will in such cases be formed in a two step process to allow the tool of the forming process to be withdrawn after formation. The two sections are then adhered or attached to each other in any convenient manner. Similar dispensing cap opening control arrangements may be included in a dispensing container with a side pivoted sealing cap, however, and the container made in a one step process. The interlocking of the cap and the container in at least a closed and an open, or dispensing, position may be effected by having protrusions on the large side walls and suitably positioned depressions on either the side of the closure cap or the side of an arcuate guiding tongue which is used to close one side of the dispensing cap as well as guide the dispensing cap into the container, or may be effected by interengaging protrusions from small side wall of the container an the outer surface of the guiding tongue.

BRIEF DESCRIPTION OF THE DRAWINGS

FIG. 1 is a sectional side view of a first version of a packaging container according to the invention with the cap approaching full open or filling position.

FIG. 2 is a section along line B—B of FIG. 4.

FIG. 3 is a section essentially as per FIG. 1, but with the closing cap in the dispensing position.

FIG. 4 is a section essentially as per FIG. 1, with the closing cap in the closed position.

FIG. 5 is a section along line A—A of FIG. 4.

DESCRIPTION OF THE PREFERRED EMBODIMENTS

Figures 6, 7, 8, 9, 10:
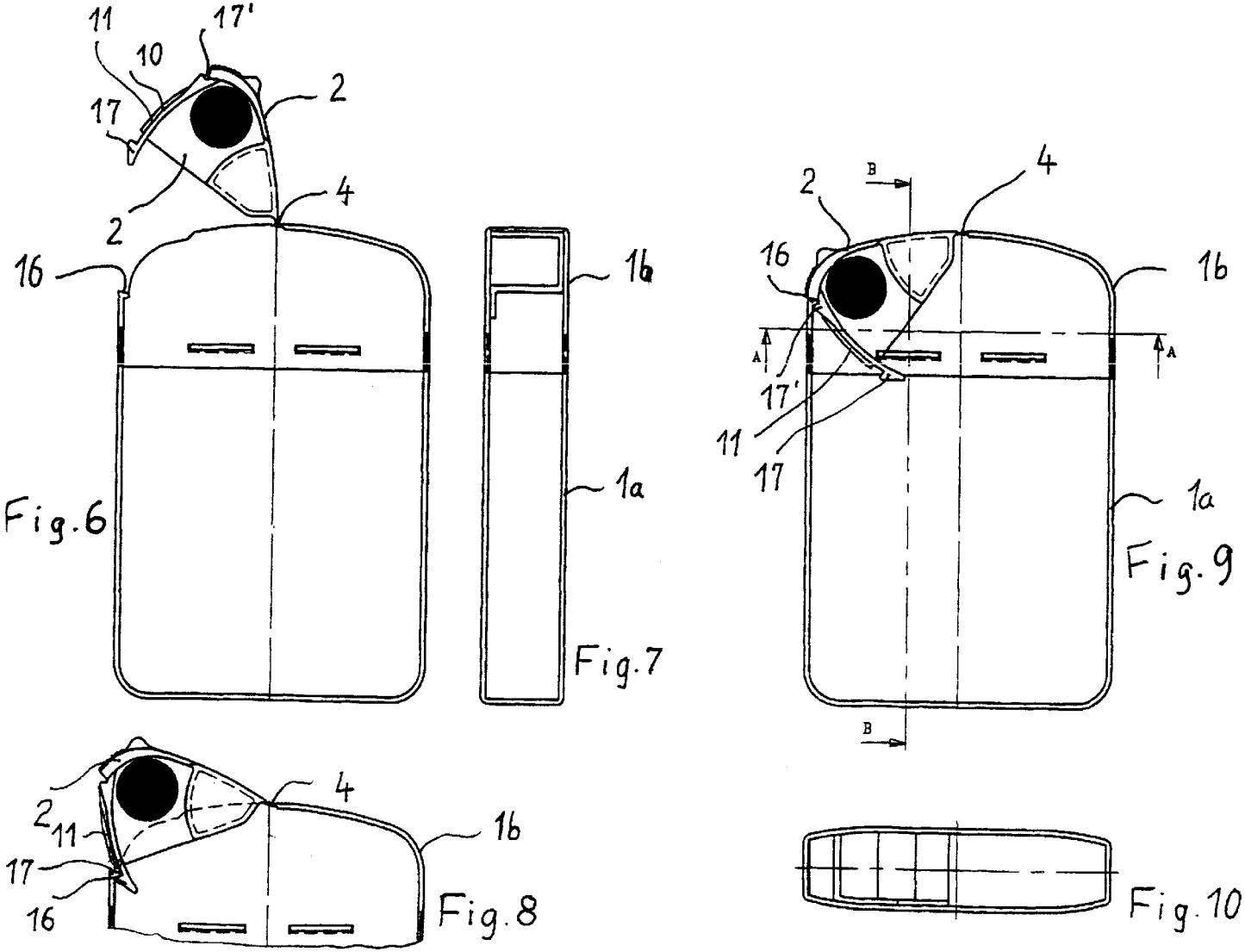
FIG. 6 is a sectional view of a second version of a packaging container according to the invention with the closing cap approaching full open or filling position.
FIG. 7 is a section along line B—B of FIG. 9.
FIG. 8 is a partial section as per FIG. 6, but with the closing cap in the dispensing position.
FIG. 9 is a section essentially as per FIG. 6, but with the closing cap in the closed position.
FIG. 10 is a section along line A—A of FIG. 9.

The invention concerns a packaging box which, in principle is constructed in the same way as the above described known packaging box. The hinged closing cap has a dispensing chamber, via which one or more tablets, which have made their way from the inside of the container to the dispensing chamber, can be dispensed from the side. The closing cap with dispensing chamber can adopt at least two positions during use: a closed position and a dispensing position. Other positions can be provided for by providing additional depressions in the structure of the dispensing cap into which a protrusion from the dispenser body may seat. A guide tongue opposite the hinge limits or defines one side of the dispensing chamber when in the dispensing position and serves to guide the closing cap when it is swung open or closed. In the case of the an already known packaging box, a locking mechanism is incorporated, consisting of a longitudinal rib, which runs along the inside of the container, along one of the two large side walls, practically over the entire length of the container. This longitudinal rib works in conjunction with corresponding spaced extensions in the closing cap, so that the two desired positions may be attained and thereby generate an audible and tangible click. The fact that the longitudinal rib practically runs along the entire length of the inside of the container, means that the interior is practically divided into two chambers and only small or thin tablets can move from one chamber to the other or from one side of the dispensing container to the other.

This known packaging box is manufactured by injection moulding in one step or in one piece, and is therefore made from a single part. For this reason, the hinge is located on a short side wall, so that the final molded closing cap can be opened far enough to allow the tool to be extracted after injection moulding.

The present invention addresses the task of creating a packaging box of the type mentioned above, which allows other forms of closing cap and in particular which allows the location of the hinge in places other than on one of the side walls.

The problems of the former dispensing container are solved by providing a thin film hinge attached to the top or upper portion of the dispensing container at right angles to or extending across the container above the level of the opening of the container and having means for locking the closure or sealing cap in closed or open position by means of protrusions and interengaging depressions or other protrusions on the side walls of the container and the sides of either the closure cap itself or the arcuate guide tongue extending into the container from the side of the closure cap opposite the thin film hinge. Since, if the closure cap is hinged to the top of the container rather than the side wall, the container must then consist of two parts, these can be manufactured in two moulds by injection moulding. The two parts are then permanently joined after release from the tool along the plane dividing such components. The hinge need then no longer be located on a side wall, since the appropriate forming tool no longer needs to be extracted through the opening that the closing or sealing cap later shuts or closes off. By virtue of this, it is also possible to locate the hinge above the level of the opening of the container, and not just on a short side wall.

Various versions of the formation and location of the locking mechanism are possible, in combination with the two piece form of the container. These are the subjects of various of the claims.

The invention is described below in more detail, with reference to drawings and various examples of different types of dispenser box.

In the drawings, the same reference numbers are used for the same components in each of the drawings.

FIG. 1 shows a container 1, which consists of two parts, namely a lower part 1*a* and an upper part 1*b*. These two parts are permanently joined together by means of adhesives or welding and/or appropriately formed connecting elements 15, which may be ridge and depression elements, or by means of an adhesive label. The general parting line 1*c* between the two sections 1*a* and 1*b* may vary somewhat depending upon whether the sections are directly butted against each other or one fits slightly within the other. By virtue of the two-part construction or manufacture, and in particular in the design of the upper part, a tool need not be extracted through the opening which is to be closed by the closing cap 2. Instead the extraction of the tools can be done through the plane dividing the components.

The closing cap 2 with a dispensing chamber 3 is moulded in one piece together with the upper part 1*b* of the container along with the connecting film hinge 4. The axis of rotation of the transverse thin film hinge 4 is designated as 13 in FIG. 1.

A grooved contact or actuating area 8 near the front of the closing cap opposite hinge 4, affords grip for the thumb when opening and closing the dispensing cap. See FIG. 4.

The large side walls of the container are marked as 5 and 5', see FIG. 2, and the short side walls as 14 and 14', see FIG. 1. The section is essentially rectangular. The base is marked as 14".

A small protrusion 6, which forms part of a locking mechanism, is located on the inside of the large side wall 5 of the upper part of the container section 1b. This protrusion interengages or works together with depressions 7 and 7' in the appropriate side wall of the closing cap 2 to hold the closing cap in its working positions. Depression 7' defines the dispensing position and depression 7 defines the closed position. The depressions 7 and 7' are separated by the central dividing rib 11 and lie on a radius about the axis of rotation 13, corresponding to the distance of the protrusion 6 from the axis of rotation.

The dispensing chamber 3 is open at the side, or on one side, and is closed by a guide tongue 10 at the front, i.e. on the side lying opposite the hinge 4. Together with the adjacent walls 14', 5 and 5', the guide tongue 10 serves as a guiding element when closing the sealing or closing cap 2. When in the position illustrated in FIG. 3, the tablets shown can be taken from the side, via the dispensing chamber 3.

When the closing cap 2 is closed for the first time, a locking protrusion 9 on the closing cap has to be pushed over the protrusion 6, in order that the true dispensing and closed positions may be taken up. Depressions 7 and 7', mentioned previously in the overall protrusion 9, define the closed and dispensing positions of the sealing cap.

As illustrated in FIGS. 1, 3 and 4, the hinge 4 lies in or above the plane defined by the opening 12 and between the short side walls 14 and 14', preferably on a central axis. This allows a relatively small closing cap to be used, the radius of rotation of which is correspondingly small. Having a small opening and closing cap is particularly convenient in saving overall plastic material in manufacture as well as being more convenient for dispensing small tablets.

The locking mechanism of the version, or embodiment, of the invention illustrated in FIGS. 6 to 10 is formed by a protrusion 17 and a notch 17' formed on the guide tongue 10, separated by the central dividing rib 11. These two components work together with a small hook 16 or protrusion located on the short side wall of the upper part 1*b* of the container 1. Apart from this differing arrangement and form of the locking mechanism, this version is constructed and designed like the one shown in FIGS. 1 to 5.

When in the dispensing position as illustrated in FIG. 8, the closing cap is constrained by the hook 16 and protrusion 17. When in this position, the tablet can be taken out from the side. In the closed position as illustrated in FIG. 9, the hook 16 engages with the notch 17'. It will be understood that in the embodiment shown in FIGS. 6 through 10 that the hook or protrusion 16 will preferably have a fairly sharp end and preferably a slightly downturned end in order to better engage protrusion 17 and notch 17.

Figures 11, 12, 13, 14, 15:
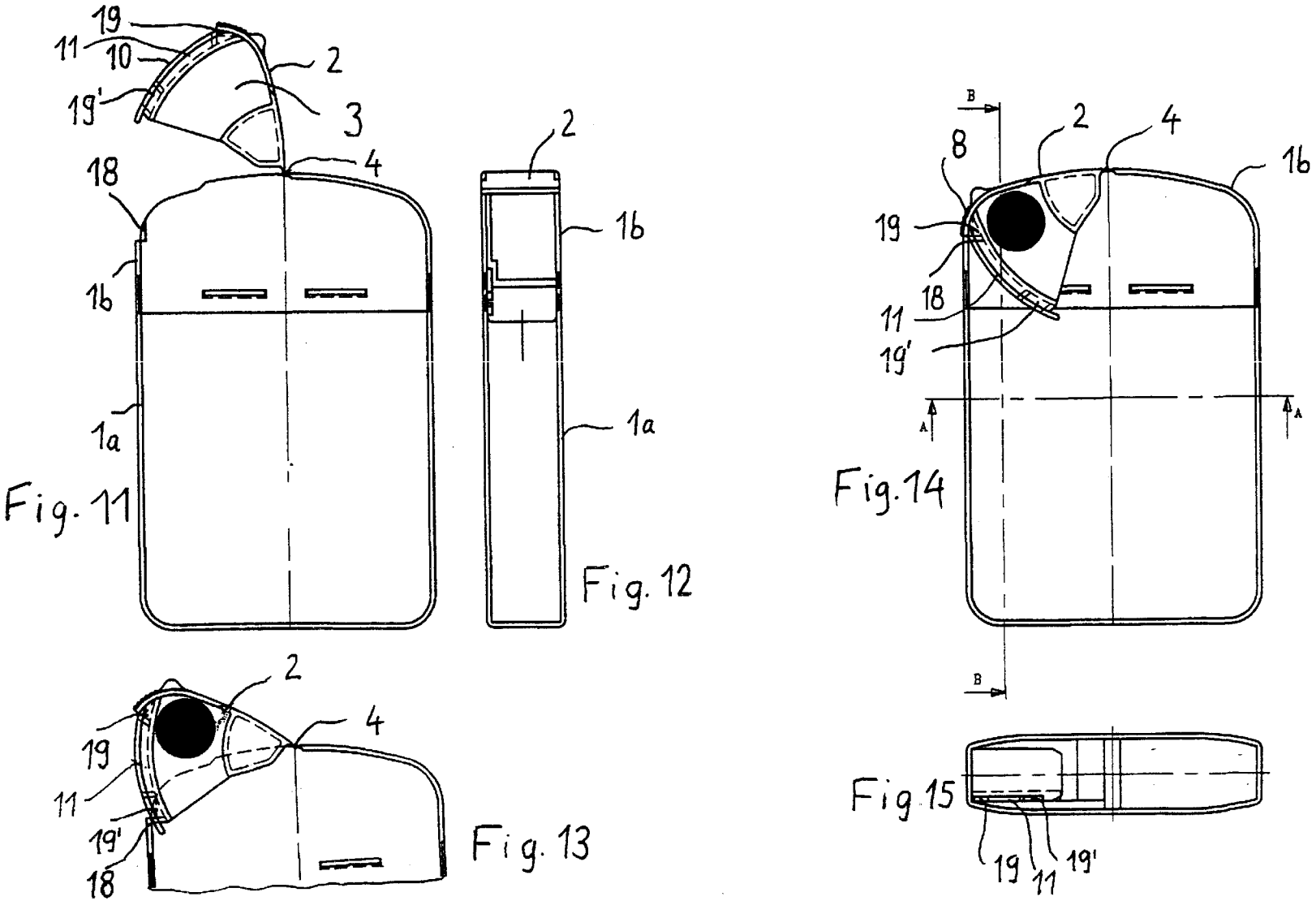
FIG. 11 is a sectional view of a third version of a packaging container according to the invention with the closing cap approaching the full opening or filling position.
FIG. 12 is a section along line B—B of FIG. 14.
FIG. 13 is a section essentially as per FIG. 11, but with the closing cap in the dispensing position.
FIG. 14 is a section essentially as per FIG. 11, but with the closing cap in the closed position.
FIG. 15 is a section along line A—A of FIG. 14.

The version of the invention illustrated in FIGS. 11 to 15 differs from those already described in that the locking mechanism is different yet again. A protrusion 18 is located on the large side wall 5 of the upper part 1*b*, directly next to the short side wall 14'. This protrusion 18 corresponds to and is intended to engage with depressions 19 and 19' located next to or along the edge or back of the guide tongue 10 of the closing cap 2, namely to the side of and next to the guide tongue or alternatively along the back of the guide tongue. The depression 19' defines the dispensing position (FIG. 13),and the depression 19 defines the closed position (FIG. 14). Both the depressions 19 and 19' are separated by the central dividing rib 11. The depressions 19 and 19' may be formed in several different manners and may comprise essentially notches in the side of the tongue, matched extensions from the side of the tongue or from the back of the tongue and the like.

All of the above described versions or embodiments of the invention have the same two-part construction of the container and the location of the thin film hinge, which is approximately on the central axis of the container at one side of the opening 12, in common. The locking mechanisms are variously formed, as appropriate. Thus, the major preferred construction of all the embodiments enabling a smaller closure cap to be used is the same. It will be understood, however, that as described above the locking arrangements may vary as explained and that each of such locking arrangements could in itself be used also in a single section dispensing container in which the sealing top is pivoted directly from one of the side walls.

By use of the present invention a very practical dispensing container having a smaller sealing cap than has hither to been possible is made possible with the ability to dispense single tablets from a smaller opening.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the applicable prior art and therefore to effectively encompass the intended scope of the invention.

What is claimed is:

1. A packaging box for tablets with a closing cap designed for dispensing of tablets from various attitudes with a dispensing chamber open to the interior of the container with an essentially rectangular cross section, and which can be rotated about a hinge, whose axis is at right angles to the large area of the container, whereby a locking mechanism is located between the inner wall of the container and the adjacent wall of the closing cap, which engages the closing cap in the dispensing and closed positions, characterized by the fact that the container (1) is formed in two parts (1*a*, 1*b*) of which one part (1*b*) exhibits the closing cap (2) with the hinge (4), and that the axis of rotation (13) of the hinge (4) lies above the level of the opening (12) of the container (1) when the packaging box is in an upright position while allowing dispensing of tablets from the closing cap in dispensing position from various attitudes of the packaging box.

2. Packaging box in accordance with claim 1, characterised by the fact that the axis of rotation (13) of the hinge (4) lies approximately in the middle between the short side walls (14, 14') of the container (1).

3. Packaging box in accordance with claim 1 or 2, characterised by the fact that the locking mechanism is formed by a protrusion (6) on the large interior wall of the container adjacent to the opening (12) of the container, and that two depressions (7, 7') formed in the wall of the closing cap (2) lie on a radius of rotation equal to the distance of the protrusion (6) from the axis of the hinge (13), one of which (depressions) corresponds to the dispensing position and the other to the closed position of the closing cap (2).

4. Packaging box in accordance with claim 1 or 2, with a guide tongue (10) located on the closing cap (2) opposite the hinge (4), characterised by the fact that the locking mechanism is formed at the free end of the guide tongue and on adjacent side wall (14) in the area of the opening of the appropriate container part (1*b*).

5. Packaging box in accordance with claim 4, characterised by the fact that the locking mechanism is formed by a protrusion (17) at the free end, and a notch (17') at the other end of the guide tongue (10) as well as by a hook (16) on the adjacent side wall (14) in the area of the opening (12) of the appropriate container part (1*b*).

6. Packaging box in accordance with claim 3, characterised by the fact that the protrusion (18) is directly adjacent to the side wall (14) in the area of the opening (12) of the appropriate container part (1*b*) and that the depressions (19, 19') are formed at the side, next to the guide tongue (10).

7. A dispensing container for tablets comprising:

(a) a hollow container (b) a pivoted dispensing cap attached to the container by a thin film hinge at one side of the dispensing cap plus an arcuate guide tongue on the other side of the cap for guiding the cap between closure and dispensing positions, (c) a dispenser cap position determining arrangement having at least one protrusion from the side wall of the hollow container adapted to releasably interengage with at least two matching depressions on the dispensing cap when the dispensing cap is in closed position and when it is in dispensing position.

8. A dispensing container for tablets in accordance with claim 7 wherein the protrusion on the side wall of the container is on the inside of the long side wall of the container adjacent the top and the depressions in the dispensing cap are on the side closure wall of the dispensing cap.

9. A dispensing container for tablets in accordance with claim 8 wherein the depressions on the side wall of the dispensing cap are between a dispensing position of a tablet in the dispensing cap and the thin film hinge.

10. A dispensing container for tablets in accordance with claim 7 wherein the protrusion on the side of the container is in the form of at least a semi-hook mounted on the wall of the container and the depressions on the cap are in the form of notches into or behind which the semi-hook releasably engages located upon the outer surface of the arcuate guide tongue.

11. A dispensing container for tablets in accordance with claim 7 wherein the protrusion from the container is in the corner near the top of the container adjacent the position of the arcuate guide tongue in closed and dispensing position of the cap and the depressions on the cap are positioned on the side of the arcuate guide tongue.

12. A dispensing container for tablets in accordance with claim 11 wherein the depressions are between raised sections on the tongue.

13. A dispensing container for tablets in accordance with claim 11 wherein the depressions are notches in the side of the arcuate tongue.

14. A dispensing container for tablets in accordance with any one of claims 9, 10, 11, 12 and 13 wherein the thin film hinge is positioned at the top of the container at an elevation above the container opening which opening is smaller than the transverse cross section of the container.

* * * * *